US011311985B2

(12) United States Patent
Li

(10) Patent No.: US 11,311,985 B2
(45) Date of Patent: Apr. 26, 2022

(54) MULTI-SIZE WRENCH AND A SHIFTING DEVICE APPLIED THERETO

(71) Applicants: HUA WEI TOOLS CO., LTD., Yunlin County (TW); JOONG JYA ENTERPRISE CO., LTD., Taichung (TW)

(72) Inventor: Zhong-Song Li, Yunlin County (TW)

(73) Assignee: HUA WEI TOOLS CO., Yunlin County (TW)

( * ) Notice: Subject to any disclaimer, the term of this patent is extended or adjusted under 35 U.S.C. 154(b) by 84 days.

(21) Appl. No.: 16/883,725

(22) Filed: May 26, 2020

(65) Prior Publication Data

US 2021/0069874 A1 Mar. 11, 2021

(30) Foreign Application Priority Data

Sep. 5, 2019 (TW) ..... 108132065

(51) Int. Cl.
*B25B 13/46* (2006.01)
*B25B 13/48* (2006.01)
*B25B 23/00* (2006.01)

(52) U.S. Cl.
CPC ..... *B25B 13/481* (2013.01); *B25B 13/462* (2013.01); *B25B 23/0007* (2013.01)

(58) Field of Classification Search
CPC . B25B 13/481; B25B 13/462; B25B 23/0007; B25B 13/102
USPC ..... 81/60, 124.4, 124.6, 52
See application file for complete search history.

(56) References Cited

U.S. PATENT DOCUMENTS 2,711,112 A * 6/1955 Durand ..... B25B 13/461 81/185
3,187,610 A * 6/1965 Charles ..... B25B 13/102 81/185
8,939,049 B2 * 1/2015 Li ..... B25B 13/06 81/124.4
9,027,444 B2 * 5/2015 Chang ..... B25B 13/06 81/60
2018/0169840 A1 * 6/2018 Lowder ..... B25B 13/102

* cited by examiner

*Primary Examiner* — Joseph J Hail
*Assistant Examiner* — Shantese L McDonald
(74) *Attorney, Agent, or Firm* — Sinorica LLC

(57) ABSTRACT

A shifting device includes a sleeve module and a shifting member movably disposed in the sleeve module. The sleeve module has a through hole. The through hole is divided into a first hole region, a buffering region, and a second hole region. The shifting member includes a third operating section and a fourth operating section. The shifting member is movable between a first position and a second position. The fourth operating section of the shifting member is situated in the buffering region when the shifting member assumes the first position, and the second hole region and the third working hole are adapted to turn a fastening member. The third operating section of the shifting member is situated in the buffering region when the shifting member assumes the second position, and the first hole region and the fourth working hole are adapted to turn the fastening member.

11 Claims, 8 Drawing Sheets

MULTI-SIZE WRENCH AND A SHIFTING DEVICE APPLIED THERETO

BACKGROUND OF THE INVENTION

1. Field of the Invention

This invention relates to a hand tool and relates particularly to a multi-size wrench and a shifting device applied thereto.

2. Description of the Related Art

An improvement of a conventional socket wrench 1 published by Taiwanese Utility Model no. M576520 is disclose and includes a wrench head 11, an outer sleeve body 12 extending in a lengthwise direction and detachably connected to the wrench head 11, and an inner sleeve 13 movably disposed through the outer sleeve body 12. The outer sleeve body 12 includes a first working hole 121 formed at one end, a second working hole 121 formed at the other end, and an accommodation space 123 which communicates the first working hole 121 with the second working hole 122 and has a smaller width. The inner sleeve 13 includes a third working hole 131 formed at one end and a fourth working hole 132 formed at the other end. Referring to FIG. 1 showing a working position, a portion of the first working hole 121 and the fourth working hole 132 can be used to turn two sizes of screws. Referring to FIG. 2 showing another working position, a portion of the second working hole 122 and the third working hole 131 can be used to turn another two sizes of screws. Therefore, the movement of the inner sleeve 13 allows different working holes 131, 132 to become active, thereby attaining the effect of working with multiple sizes of screws.

However, because the third working hole 131 and the fourth working hole 132 cannot enter the accommodation space 123 while switching the working positions, the first working hole 121, the second working hole 122, and the accommodation space 123 which extend in the lengthwise direction may become too long and may have many variations in their inner diameters. These conditions make the manufacture of the outer sleeve body 12 more complicated, cause the low product yield, and render the product unable to work in a small working space.

SUMMARY OF THE INVENTION

A first object of this invention is to provide a shifting device applied to a multi-size wrench and capable of being conveniently manufactured and being used in a small space.

A shifting device of this invention is applied to a multi-size wrench. The multi-size wrench is adapted to turn a fastening member and includes a mounting hole penetrating therethrough along an axis and a mounting flange formed around the mounting hole. The shifting device includes a sleeve module and a shifting member.

The sleeve module is inserted into the mounting hole and abuts against the mounting flange. The sleeve module defines a through hole extending along the axis, a first side surface formed at one end, and a second side surface formed at another end. The through hole extends from the first side surface to the second side surface along the axis and is divided into a first hole region, a buffering region, and a second hole region in sequence.

The shifting member is movably disposed in the through hole along the axis and includes a third operating section and a fourth operating section extending along the axis. The third operating section has a third working hole extending along the axis, and the fourth operating section has a fourth working hole extending along the axis. By comparison with the location of the fourth working hole, the location of the third working hole is closer to the first side surface. The shifting member is movable along the axis and movable between a first position and a second position. When the shifting member assumes the first position, the shifting member is close to the first side surface, the fourth operating section of the shifting member is situated in the buffering region of the through hole, and the third operating section is situated in the first hole region of the through hole. Accordingly, the second hole region and the third working hole are adapted to turn the fastening member. When the shifting member assumes the second position, the shifting member is far from the first side surface, the third operating section of the shifting member is situated in the buffering region, and the fourth operating section of the shifting member enters the second hole region of the through hole. Accordingly, the first hole region and the fourth working hole are adapted to turn the fastening member.

A second object of this invention is to provide a multi-size wrench capable of being conveniently manufactured and being used in a small space.

The multi-size wrench of this invention is adapted to turn a fastening member and includes a wrench body and the aforementioned shifting device.

The wrench body includes a mounting hole penetrating therethrough along an axis and a mounting flange formed around the mounting hole.

The shifting device is inserted in the mounting hole and abuts against the mounting flange.

A significant effect of this invention is that the spatial cooperation between the through hole and shifting member allows the fourth operating section of the shifting member to be situated in the buffering region of the through hole when the shifting member is in the first position and also allows the third operating section of the shifting member to be situated in the buffering region when the shifting member is in the second position. Accordingly, the length of the through hole extending along the axis can be reduced to decrease the length of the sleeve module, which facilitates the manufacture and is adapted to a smaller working space.

BRIEF DESCRIPTION OF THE DRAWINGS

Other features and effects of this invention will become better understood by reference to the preferred embodiments when considered in connection with the accompanying drawings and wherein.

DETAILED DESCRIPTION OF THE PREFERRED EMBODIMENTS

Figure 1:
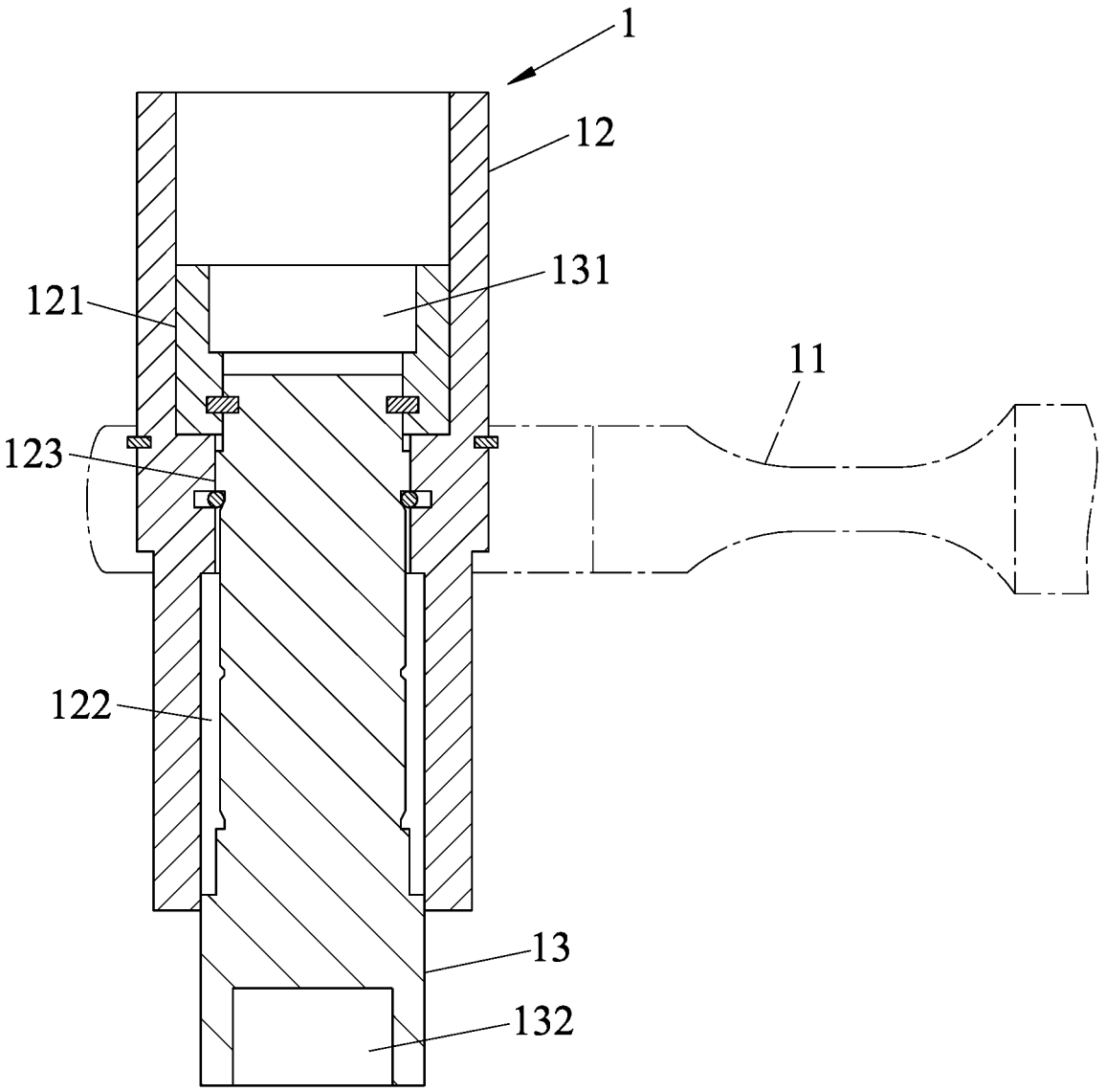
FIGS. 1 and 2 are cross-sectional views showing an improvement of a conventional socket wrench disclosed by Taiwanese Utility Model no. M576520.
Figure 2:
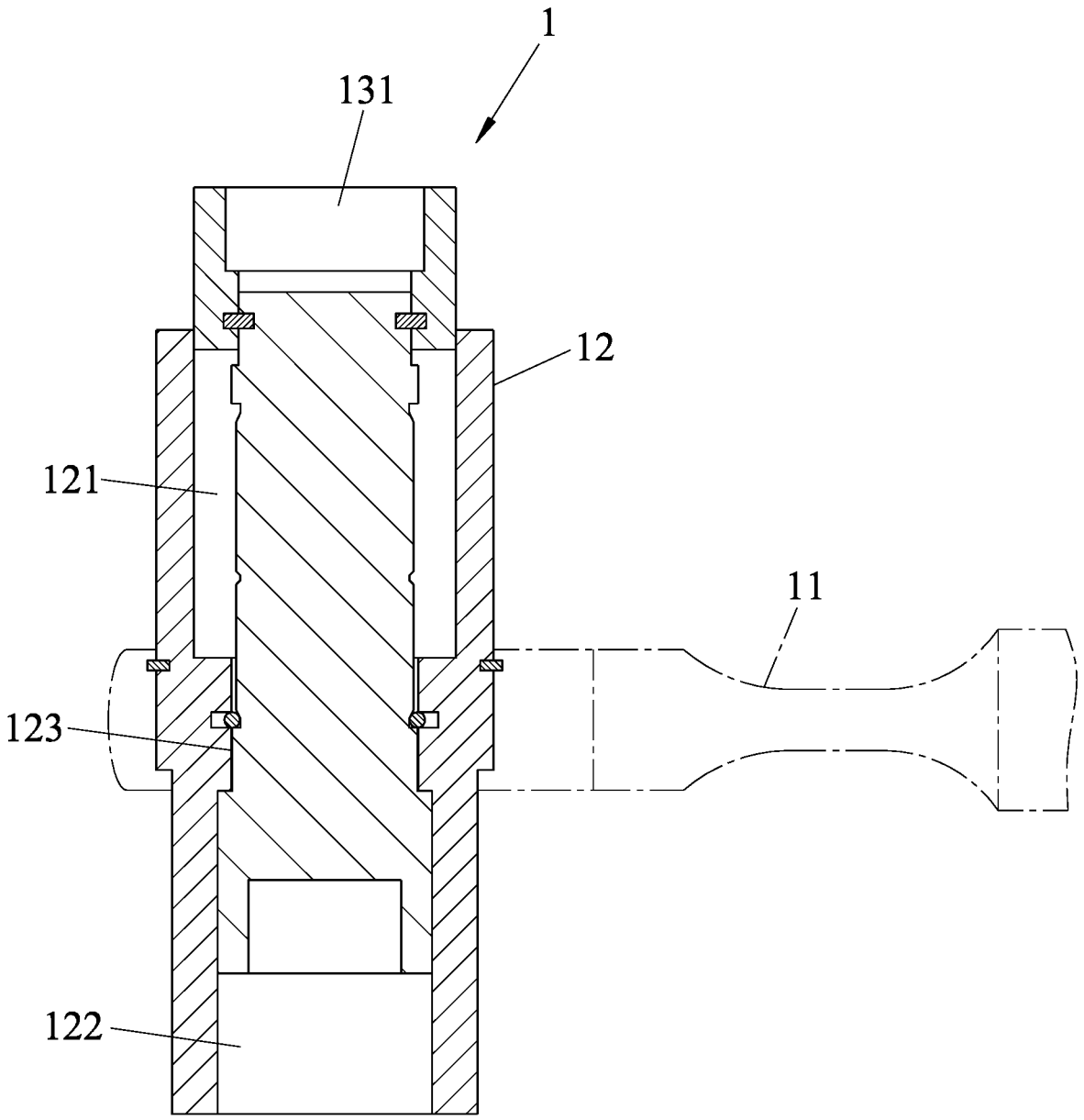
Figure 3:
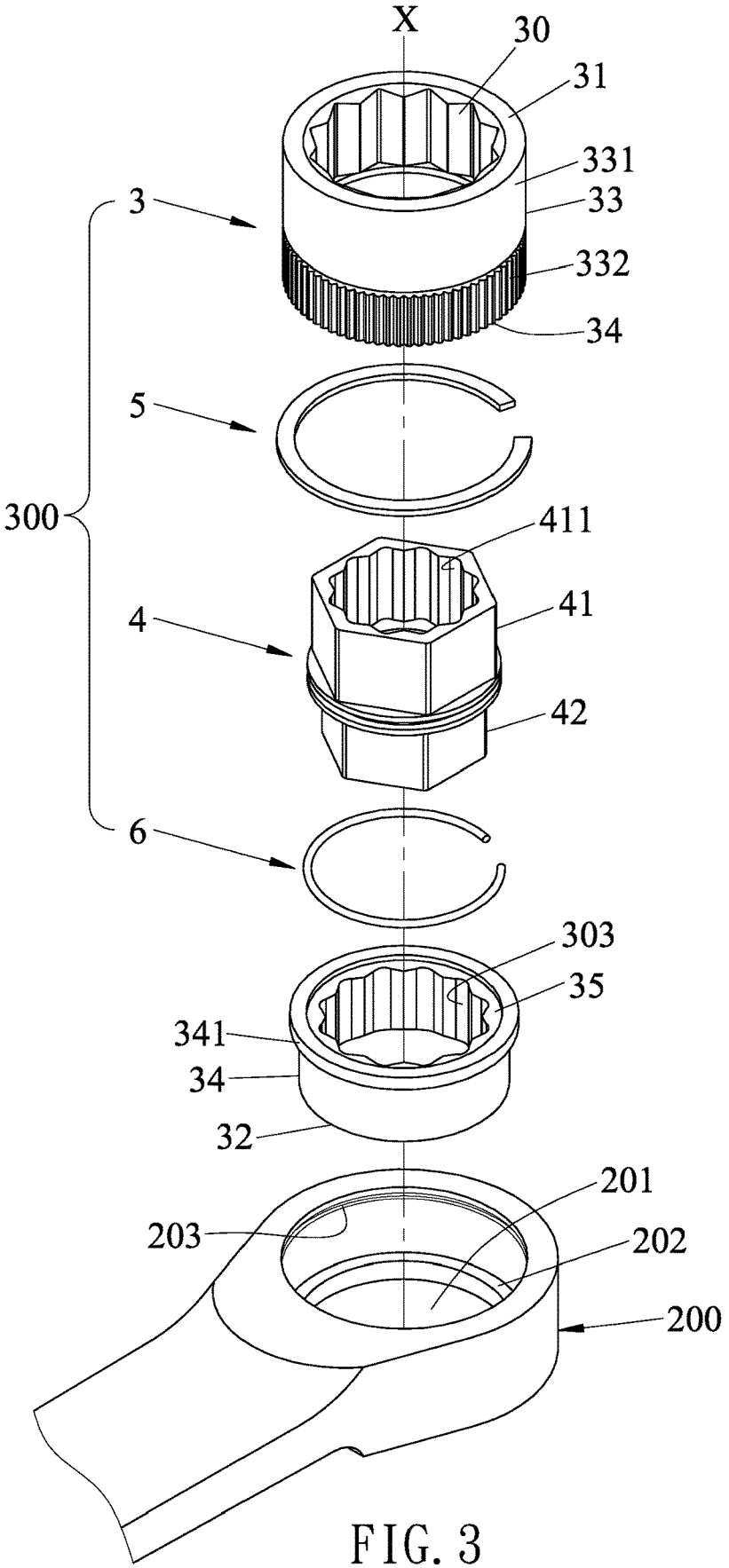
FIG. 3 is a partial exploded view showing a preferred embodiment of this invention.
Figure 4:
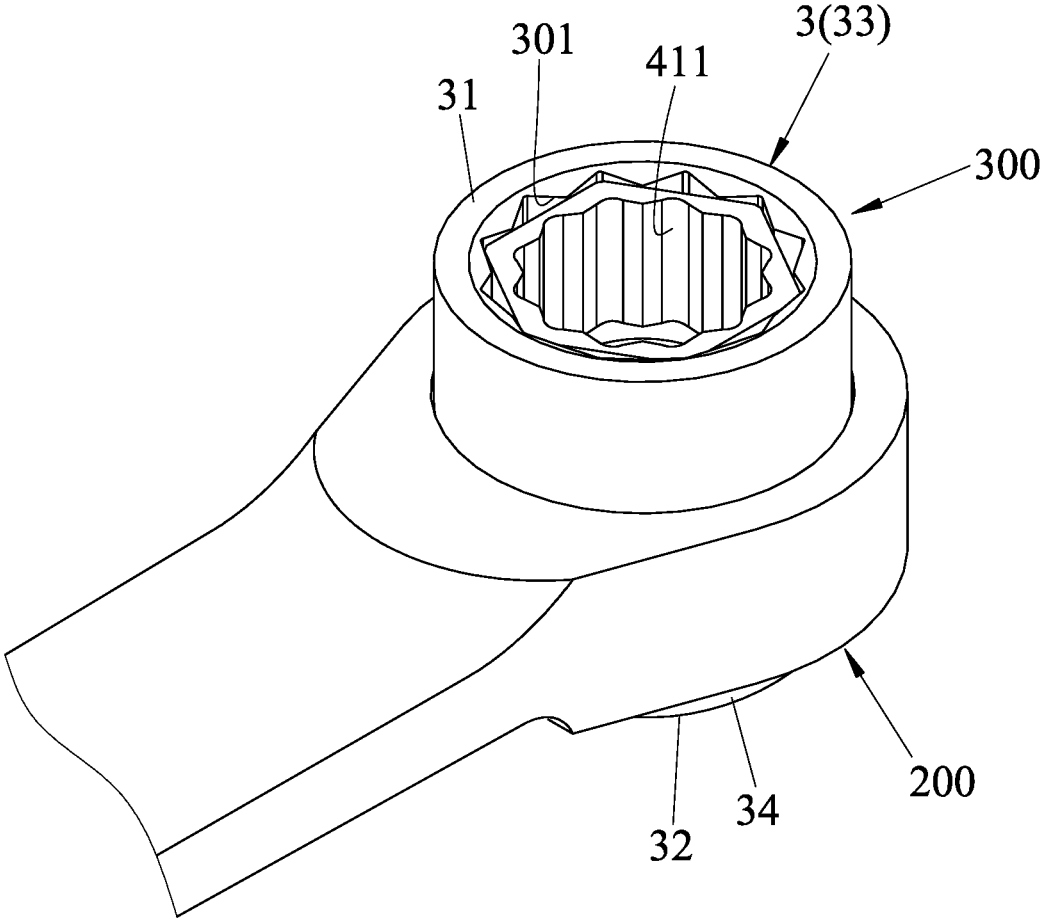
FIG. 4 is a partial perspective view showing an assemblage of the preferred embodiment.
Figure 5:
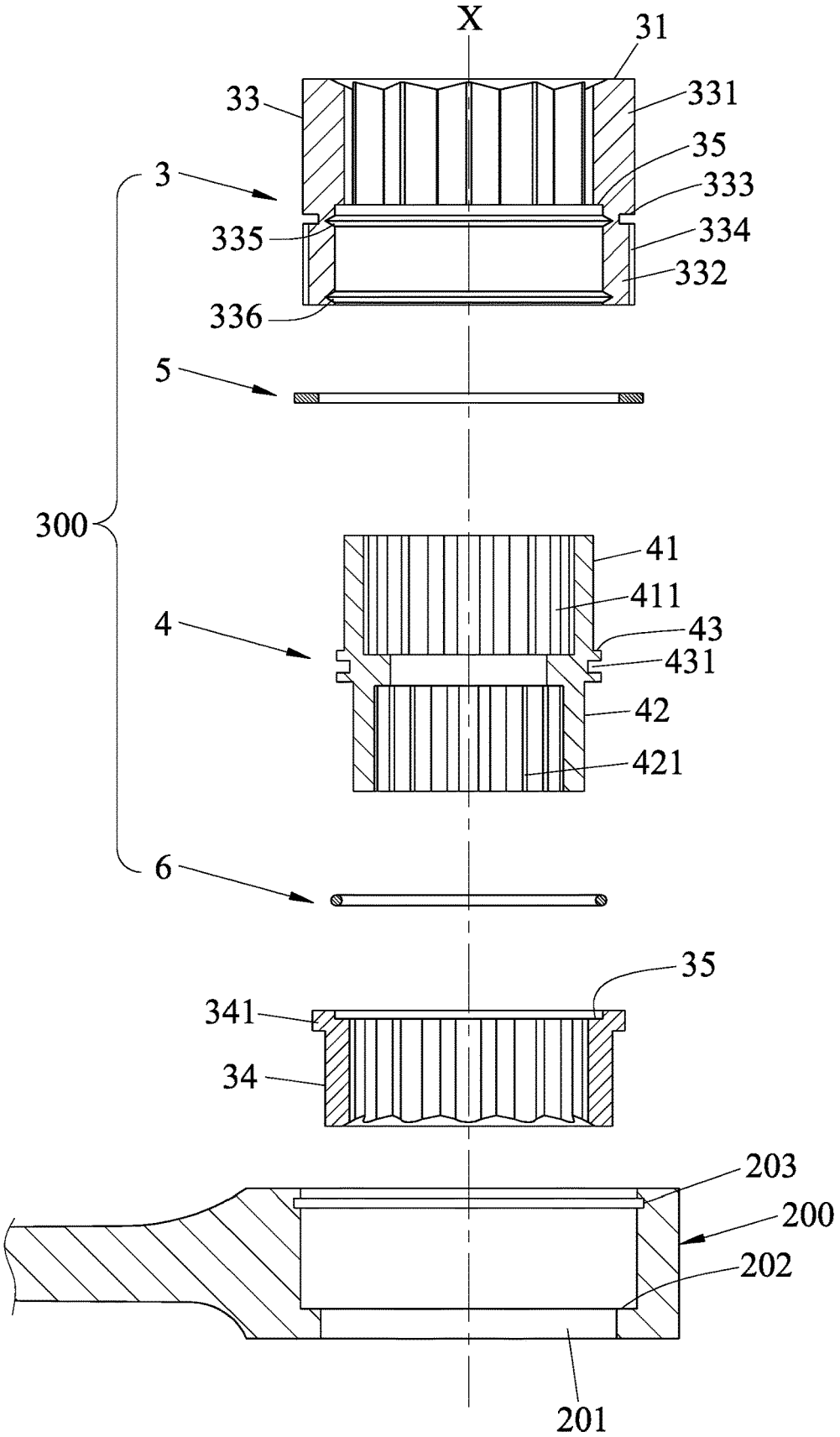
FIG. 5 is a partial cross-sectional and exploded view of the preferred embodiment.

Referring to FIG. 3, FIG. 4, and FIG. 5, a preferred embodiment of a multi-size wrench of this invention is adapted to turn a fastening member (not shown in figures) and includes a wrench body 200 gripped by a user and a shifting device 300 installed in the wrench body 200.

The wrench body 200 includes a mounting hole 201 penetrating therethrough along an axis X, a mounting flange 202 formed around the mounting hole 201, and a recess 203 formed on an inner surface.

The shifting device 300 includes a sleeve module 3, a shifting member 4, a C-type ring 5, and an engagement member 6.

Figure 6:
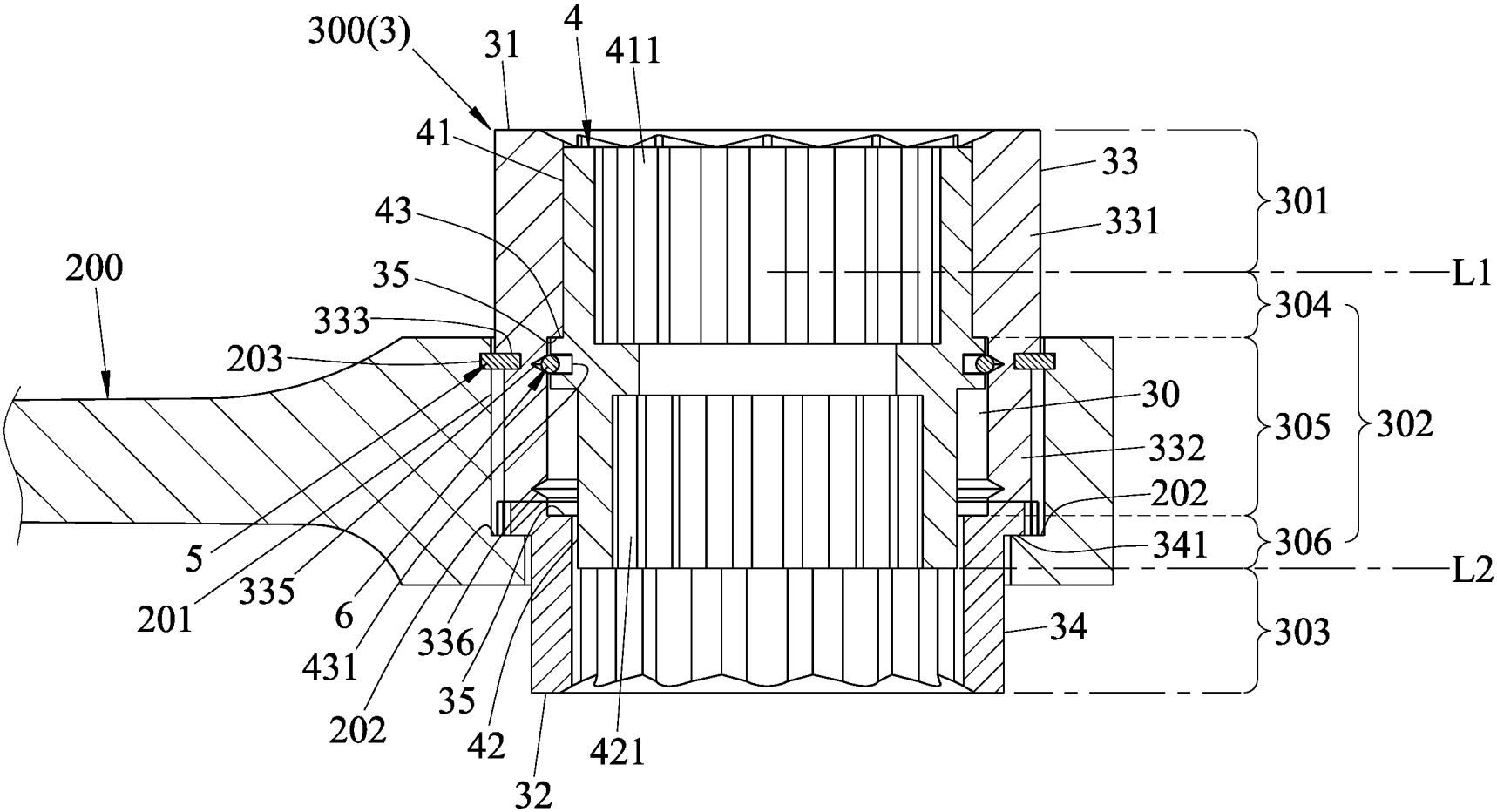
FIGS. 6 and 7 are cross-sectional views showing that a shifting member of the preferred embodiment is situated in a first position and a second position respectively.

Referring to FIG. 4, FIG. 5, and FIG. 6, the sleeve module 3 is inserted into the mounting hole 201 and defines a through hole 30 extending along the axis X. The sleeve module 3 includes a first side surface 31 and a second side surface 32 formed at two ends, a first sleeve 33 and a second sleeve 34 disposed along the axis X, and two block portions 35, one of which is disposed on an inner surface of the first sleeve 33, and the other one of which is disposed on an inner surface of the second sleeve 34.

The through hole 30 extends from the first side surface 31 to the second side surface 32 along the axis X and is divided into a first hole region 301, a buffering region 302, and a second hole region 303 in sequence.

The first hole region 301 and the second hole region 303 are adapted to turn the fastening member (not shown in figures). The fastening member can be a nut or a sleeve.

A first imaginary line L1 is defined on the first sleeve 33 and serves to differentiate the first hole region 301 from the buffering region 302, and a second imaginary line L2 is defined on the second sleeve 34 and serves to differentiate the second hole region 303 from the buffering region 302. The buffering region 302 is located between the first imaginary line L1 and the second imaginary line L2. The buffering region 302 extends from the first imaginary line L1 to the second imaginary line L2 along the axis X and is sequentially divided into a first area 304, a second area 305, and a third area 306.

In this preferred embodiment, a minimum extending length of the first area 304 perpendicular to the axis X and a minimum extending length of the third area 306 perpendicular to the axis X can be smaller than a minimum extending length of the second area 305 perpendicular to the axis X. The minimum extending length of the first area 304 perpendicular to the axis X is substantially equal to a minimum hole diameter of the first hole region 301, and the minimum extending length of the second area 305 perpendicular to the axis X is substantially equal to a minimum hole diameter of the third working hole 411. In a variation of this preferred embodiment, the buffering region 302 can have a change in the hole diameter. For example, the minimum extending lengths of the first area 304 and the third area 306 perpendicular to the axis X can be larger than the minimum extending length of the second area 305 perpendicular to the axis X.

The first sleeve 33 includes a perforated section 331 which defines the first hole region 301, a support section 332 extending from the perforated section 331 in a direction far from the first side surface 31, a mounting slot 333 formed on an outer surface, a ratchet teeth portion 334 formed on an outer surface of the support section 332, and a first inner annular groove 335 and a second inner annular groove 336 respectively formed on an inner surface and spaced from each other along the axis X.

In this preferred embodiment, the ratchet teeth portion 334 is formed on the outer surface of the support section 332. In one variation of this preferred embodiment, the ratchet teeth portion 334 can be formed on both outer surfaces of the support section 332 and the perforated section 331 to thereby increase the torque of turning the fastening member (not shown in figures). In another variation of this preferred embodiment, the ratchet teeth portion 334 can be formed on both outer surfaces of the support section 332 and the second sleeve 34, and two sets of triangular teeth (not shown in figures) can be used to work with the ratchet teeth portion 334 respectively formed on the outer surfaces of the support section 332 and the second sleeve 34 to thereby increase the torque of turning the fastening member.

It is noted that in this preferred embodiment, the first inner annular groove 335 and the second inner annular groove 336 are formed on an inner surface of the first sleeve 33. In a variation of this preferred embodiment, at least one of the two inner annular grooves, namely the first inner annular groove 335 and the second inner annular groove 336, can be formed on the inner surface of the second sleeve 34.

The second sleeve 34 forms a mounting collar section 341 around an outer surface thereof for abutting against the mounting flange 202 and defines the second hole portion 303. The second sleeve 34 cooperates with the support section 332 so that the buffering region 302 is defined. The mounting collar section 341 is in contact with the support section 332 of the first sleeve 33.

In this preferred embodiment, the block portions 35 are respectively formed on the inner surfaces of the first sleeve 33 and the second sleeve 34 and are respectively located adjacent to the first inner annular groove 335 and the second inner annular groove 336, thereby serving to differentiate the first area 304 from the second area 305 and differentiate the second area 305 from the third area 306, respectively.

It is noted that in a variation of this preferred embodiment, the block portions 35 can also be used to differentiate the first hole portion 301 from the buffering region 302 and to differentiate the buffering region 302 from the second hole portion 303, and concurrently the first area 304, the second area 305, and the third area 306 can have the same hole diameter. Accordingly, the aforementioned arrangement also attains the effect of limiting the position of the shifting member 4 by using the block portions 35.

The shifting member 4 can be movably disposed in the through hole 30 along the axis X and includes a third operating section 41 and a fourth operating section 42 each extending in the direction of the axis X and a flange portion 43 formed on an outer surface and movably situated in the second area 305 of the through hole 30.

In this preferred embodiment, the flange portion 43 and each of the block portions 35 can be a collar formed in a closed circular shape so that the flange portion 43 are allowed to be braced against the block portions 35 for positioning. In a variation of this preferred embodiment, it is possible that either the flange portion 45 or each block portion 35 can be a collar formed in a closed circular shape, and the rest can be formed in a positioning structure capable of abutting against the collar, such as a protrusion. This arrangement also attains the same effect as previously described.

The third operating section 41 and the fourth operating section 42 have a third working hole 411 and a fourth working hole 421 extending respectively along the axis X for being adapted to turn the fastening member. By comparison with the location of the fourth working hole 421, the location of the third working hole 411 is closer to the first side surface 31.

The flange portion 43 has a locking slot 431 recessedly formed on the outer surface thereof.

In this preferred embodiment, the first hole region 301, the second hole region 303, the third working hole 411, and the fourth working hole 421 differ in having different minimum hole diameters, and the minimum hole diameters are put in descending order, i.e. from greatest to least: the minimum hole diameter of the first hole region 301, the minimum hole diameter of the second hole region 303, the minimum hole diameter of the third working hole 411, and the minimum hole diameter of the fourth working hole 421. Accordingly, it can be applied to four different sizes of fastening members (not shown in figures).

Figure 7:
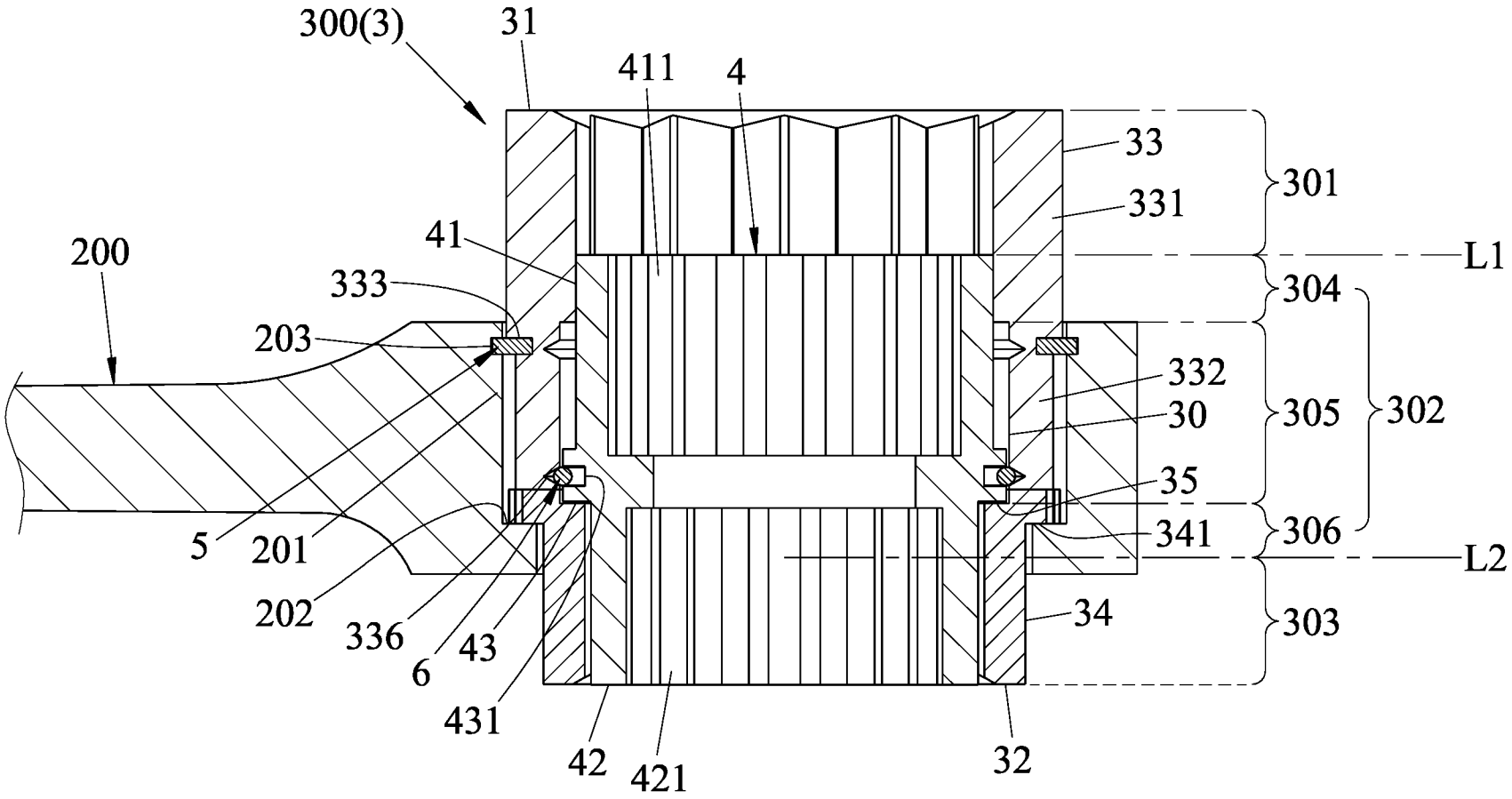

Referring to FIG. 5, FIG. 6, and FIG. 7, the shifting member 4 is movable along the axis X and movable between a first position (shown in FIG. 6) and a second position (shown in FIG. 7). When the first position is assumed and shown in FIG. 6, the shifting member 4 is close to the first side surface 31, and the flange portion 43 is braced against the block portion 35 of the first sleeve 33. When the second position is assumed and shown in FIG. 7, the shifting member 4 is far from the first side surface 31, and the flange portion 43 is braced against the block portion 35 of the second sleeve 34.

The C-type ring 5 is disposed between the mounting slot 333 and the recess 203 to fix the first sleeve 33 to the mounting hole 201. Thus, the sleeve module 3 does not escape from the wrench body 200 easily. Preferably, the C-type ring 5 can be a flexible material.

The engagement member 6 is disposed in the locking slot 431. When the shifting member 4 is situated in the first position shown in FIG. 6, the engagement member 6 is lodged in the first inner annular groove 335. When the shifting member 4 is situated in the second position shown in FIG. 7, the engagement member 6 is lodged in the second inner annular groove 336. Preferably, the engagement member 6 can be a flexible material.

An installation of this invention is executed by following steps. Firstly, put the second sleeve 34 into the mounting hole 201 and brace the mounting collar section 341 of the second sleeve 34 against the mounting flange 202. Secondly, after the shifting member 4 and engagement member 6 are assembled together as an assemblage, put the assemblage into the first sleeve 33 and then into the mounting hole 201. Then, push the sleeve module 3 by using a jig (not shown in figures) to allow the C-type ring 5 to be sleevedly disposed on the mounting slot 333 of the first sleeve 33. Finally, put the sleeve module 3 in which the shifting member 4 is installed, the C-type ring 5, and the engagement member 6 into the mounting hole 201 to thereby complete the installation.

An operation of this invention is executed by pushing and moving the shifting member 4 between the first position shown in FIG. 6 and the second position shown in FIG. 7 in order to turn different sizes of fastening members (not shown in figures). When a user pushes the shifting member 4 to a place adjacent to the first side surface 31 to make the shifting member 4 stop at the first position (shown in FIG. 6), the flange portion 43 abuts against the block portion 35 adjacent to the first side surface 31, i.e. the upper block portion 35 shown in FIG. 6, and the locking slot 431 points at the first inner annular groove 335 so that the engagement member 6 is limited to be situated within the first inner annular groove 335. Meanwhile, the fourth operating section 42 of the shifting member 4 is situated in the buffering region 302 of the through hole 30, and the third operating section 41 is situated in the first hole portion 301 of the through hole 30. In this case, the fastening member can be turned by the second hole portion 303 or the third working hole 411. In contrast, when the shifting member 4 is pushed far from the first side surface 31 and towards a place adjacent to the second side surface 32 and finally stops at the second position (shown in FIG. 7), the flange portion 43 abuts against the block portion 35 adjacent to the second side surface 32, i.e. the lower block portion 35 shown in FIG. 7, and the locking slot 431 points at the second inner annular groove 336 so that the engagement member 6 is limited to be situated within the second inner annular groove 336. Meanwhile, the fourth operating section 42 of the shifting member 4 enters the second hole portion 303 of the through hole 30. Accordingly, the fastening member can be turned by the first hole portion 301 or the fourth working hole 421.

Figure 8:
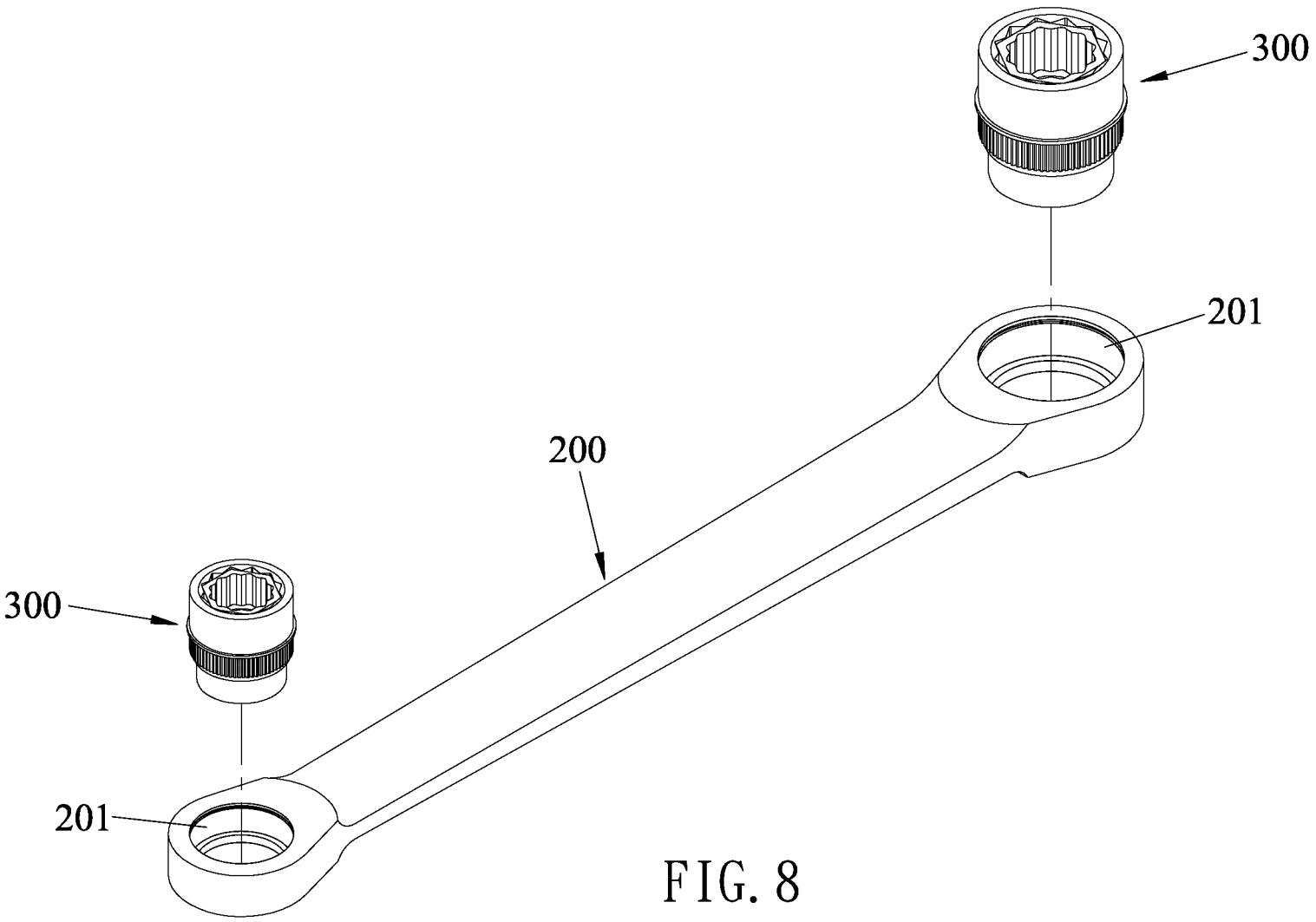
FIG. 8 is a perspective view showing a variation of the preferred embodiment of this invention.

It is noted that the shifting device 300 of this preferred embodiment can be individually manufactured, sold, and used, and its dimension can be adjusted according to different hole diameters of the mounting holes 201 as for example shown in FIG. 8 where two different sizes of shifting devices 300 are adapted to work with two mounting holes 201 of the wrench body 200 with different hole diameters. Therefore, the multi-size wrench shown in FIG. 8 can be applied to eight sizes of fastening members.

Referring to FIG. 6 and FIG. 7, the advantages of the aforementioned preferred embodiment are described as follows:

1. Because the spatial cooperation between the through hole 30 and the shifting member 4 is made, the fourth operating section 42 of the shifting member 4 is situated in the buffering region 302 of the through hole 30 when the shifting member 4 assumes the first position, and the third operating section 41 of the shifting member 4 is situated in the buffering region 302 when the shifting member 4 assumes the second position. In this case, the lengths of the shifting member 4 and the sleeve module 3 can be reduced to shorten the length of the through hole 30 extending along the axis X. Therefore, the above configuration is easy to manufacture and is capable of being used in a small space.

2. Furthermore, the concatenation of correlated elements, namely the first sleeve 33, the second sleeve 34, and the shifting member 4, can reduce respective extending lengths of elements and decrease variations in their hole diameters, so the above configuration facilitates the manufacture.

While the embodiments are shown and described above, it is understood that the embodiments related to this invention should not limit the scope of this invention and that further variations and modifications may be made without departing from the scope of this invention.

What is claimed is:

1. A shifting device applied to a multi-size wrench, said multi-size wrench being adapted to turn a fastening member and including a wrench body in which said shifting device is installed, said wrench body including a mounting hole penetrating therethrough along an axis and a mounting flange formed around said mounting hole, said shifting device comprising:

a sleeve module inserted into said mounting hole and abutting against said mounting flange, said sleeve module including a through hole extending along said axis, a first side surface formed at one end, and a second side surface formed at another end, said through hole extending from said first side surface to said second side surface along said axis and being sequentially divided into a first hole region, a buffering region, and a second hole region; and a shifting member movably disposed in said through hole along said axis and including a third operating section and a fourth operating section extending in the direction of said axis, said third operating section having a third working hole extending along said axis, said fourth operating section having a fourth working hole extending along said axis, a location of said third working hole being closer to said first side surface in comparison with a location of said fourth working hole, said shifting member being movable along said axis and movable between a first position and a second position, said shifting member being close to said first side surface to allow said fourth operating section of said shifting member to be situated in said buffering region of said through hole and to allow said third operating section to be situated in said first hole region of said through hole when said shifting member assumes said first position whereby said second hole region and said third working hole are adapted to turn said fastening member, said shifting member being far from said first side surface to allow said third operating section of said shifting member to be situated in said buffering region and to allow said fourth operating section of said shifting member to enter said second hole region of said through hole when said shifting member assumes said second position whereby said first hole region and said fourth working hole are adapted to turn said fastening member, wherein said sleeve module includes a first sleeve and a separate second sleeve disposed along said axis, said first sleeve defining said first hole region and forming said first side surface, said second sleeve defining said second hole region and forming said second side surface, said second sleeve cooperating with said first sleeve to define said buffering region therebetween.

2. The shifting device of the multi-size wrench according to claim 1, wherein said first sleeve defines a first imaginary line whereby said first hole region is differentiated from said buffering region, said second sleeve defining a second imaginary line whereby said second hole region is differentiated from said buffering region, said buffering region being located between said first imaginary line and said second imaginary line, said buffering region extending from said first imaginary line to said second imaginary line along said axis and being sequentially divided into a first area, a second area, and a third area, a minimum extending length of said first area perpendicular to said axis and a minimum extending length of said third area perpendicular to said axis being smaller than a minimum extending length of said second area perpendicular to said axis.

3. The shifting device of the multi-size wrench according to claim 2, wherein the minimum extending length of said first area perpendicular to said axis is substantially equal to a minimum hole diameter of said first hole region, the minimum extending length of said second area perpendicular to said axis is substantially equal to a minimum hole diameter of said third working hole.

4. The shifting device of the multi-size wrench according to claim 2, wherein said shifting member includes a flange portion formed on an outer surface and movably situated in said second area, said flange portion abutting against said sleeve module to limit a position of said shifting member when said shifting member assumes said first position and said second position.

5. The shifting device of the multi-size wrench according to claim 4, wherein said sleeve module includes two block portions respectively disposed on an inner surface of said first sleeve and an inner surface of said second sleeve, one of said two block portions defining said first area and said second area, another one of said two block portions defining said second area and said third area, said flange portion abutting against said one block portion of said first sleeve when said shifting member assumes said first position, said flange portion abutting against said other block portion of said second sleeve when said shifting member assumes said second position.

6. The shifting device of the multi-size wrench according to claim 5, further comprising an engagement member disposed between said first sleeve and said shifting member, said sleeve module including a first inner annular groove and a second inner annular groove formed on an inner surface, said first inner annular groove and said second inner annular groove being axially spaced from each other and formed near said two block portions respectively, said engagement member being lodged into said first inner annular groove when said shifting member assumes said first position, said engagement member being lodged into said second inner annular groove when said shifting member assumes said second position.

7. The shifting device of the multi-size wrench according to claim 6, wherein said flange portion has a locking slot for accommodating said engagement member.

8. The shifting device of the multi-size wrench according to claim 2, further comprising a C-type ring adapted to fix said first sleeve to said mounting hole, said first sleeve including a perforated section in which said first hole region is defined, a support section extending from said perforated section in a direction far from said first side surface and being in contact with said second sleeve for defining said buffering region, and a mounting slot formed on an outer surface for accommodating said C-type ring.

9. The shifting device of the multi-size wrench according to claim 8, wherein said first sleeve includes a ratchet teeth portion, said ratchet teeth portion being at least formed on an outer surface of said support section.

10. The shifting device of the multi-size wrench according to claim 1, wherein said first hole region, said second hole region, said third working hole, and said fourth working hole differ in having different minimum hole diameters.

11. A multi-size wrench adapted to turn a fastening member, said wrench comprising:

a wrench body including a mounting hole penetrating therethrough along an axis and a mounting flange formed around said mounting hole; and a shifting device as claimed in claim 1, said shifting device being inserted in said mounting hole and abutting against said mounting flange.

* * * * *